US011761728B2

(12) United States Patent
Liu

(10) Patent No.: US 11,761,728 B2
(45) Date of Patent: Sep. 19, 2023

(54) CROSSBOW WITH REPLACEABLE BOW UNIT

(71) Applicant: Chi-Chang Liu, Taichung (TW)

(72) Inventor: Chi-Chang Liu, Taichung (TW)

(73) Assignee: POE LANG ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 17/723,478

(22) Filed: Apr. 19, 2022

(65) Prior Publication Data

US 2023/0235988 A1 Jul. 27, 2023

(30) Foreign Application Priority Data

Jan. 25, 2022 (CN) ..... 202210088089.6

(51) Int. Cl.
*F41B 5/12* (2006.01)
*F41B 5/00* (2006.01)

(52) U.S. Cl.
CPC ..... *F41B 5/126* (2013.01); *F41B 5/0026* (2013.01)

(58) Field of Classification Search
CPC ..... F41B 5/126; F41B 5/0026
USPC ..... 124/25, 25.5, 80
See application file for complete search history.

(56) References Cited

U.S. PATENT DOCUMENTS 9,689,639 B1 * 6/2017 Liu ..... F16B 21/06

* cited by examiner

*Primary Examiner* — John E Simms, Jr.

(57) ABSTRACT

A crossbow includes a body includes a connection part that includes a clamping portion. The clamping portion includes two side plates, and a space is formed between the two side plates. A bow unit includes a bow and a block which is formed to the middle portion of the bow. The block includes a protrusion which is accommodated in the space and clamped between the two side plates so as to connect the bow unit to the connection part. A magazine includes the first end thereof pivotably connected to the body, and the second end of the magazine is connected to the clamping portion. The magazine includes two lugs between which the clamping portion is located. A pin extends through the two lugs, the two side plates and the block to connect the magazine to the body. By removing the pin and pivoting the magazine, the bow unit is replaced.

5 Claims, 9 Drawing Sheets

CROSSBOW WITH REPLACEABLE BOW UNIT

BACKGROUND OF THE INVENTION

1. Fields of the Invention

The present invention relates to a crossbow, and more particularly, to a crossbow with a replaceable bow unit while the magazine is pivotally connected to the crossbow.

2. Descriptions of Related Art

The conventional crossbow known to applicant is disclosed in Taiwanese Publication No. 1724942 and includes a magazine which is connected to the top of the crossbow so as to provide arrows into the flight groove one by one, such that the user does not need to put the crossbow down and reload a new arrow. The magazine includes a retainer which provide a downward force to the arrows in the magazine so that the arrow can be loaded in the flight groove of the crossbow one by one.

However, when the bow needs to be replaced, the magazine has to be dis-connected from the crossbow, then the bow is replaced with a new one. The magazine have to be empty before the magazine is removed. This is not convenient for the users and the replacement processes of the bow.

The present invention intends to provide a crossbow with a replaceable bow while the magazine is remained pivotably attached to the crossbow, so as to eliminate the shortcomings mentioned above.

SUMMARY OF THE INVENTION

The present invention relates to a crossbow and comprises a body having a stock and a connection end respectively formed to two ends of the body. A connection part is formed to the connection end and includes a clamping portion. The clamping portion includes two side plates between which a space is formed. A bow unit includes a bow and a block which is formed to the middle portion of the bow. The block includes a protrusion which is accommodated in the space and clamped between the two side plates so as to connect the bow unit to the connection part. A magazine has the first end thereof pivotably connected to the body, and the second end of the magazine is removably connected to the clamping portion. The magazine includes two lugs, and the clamping portion is located between the two lugs. A pin extends through the two lugs, the two side plates of the clamping portion and the block to pivotably connect the magazine to the clamping portion of the body.

When replacing the bow unit, the second end of the magazine is pivoted away the body by removing the pin from the clamping portion and the protrusion of the bow unit, such that the bow unit is replaced without removing the magazine from the body of the crossbow.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
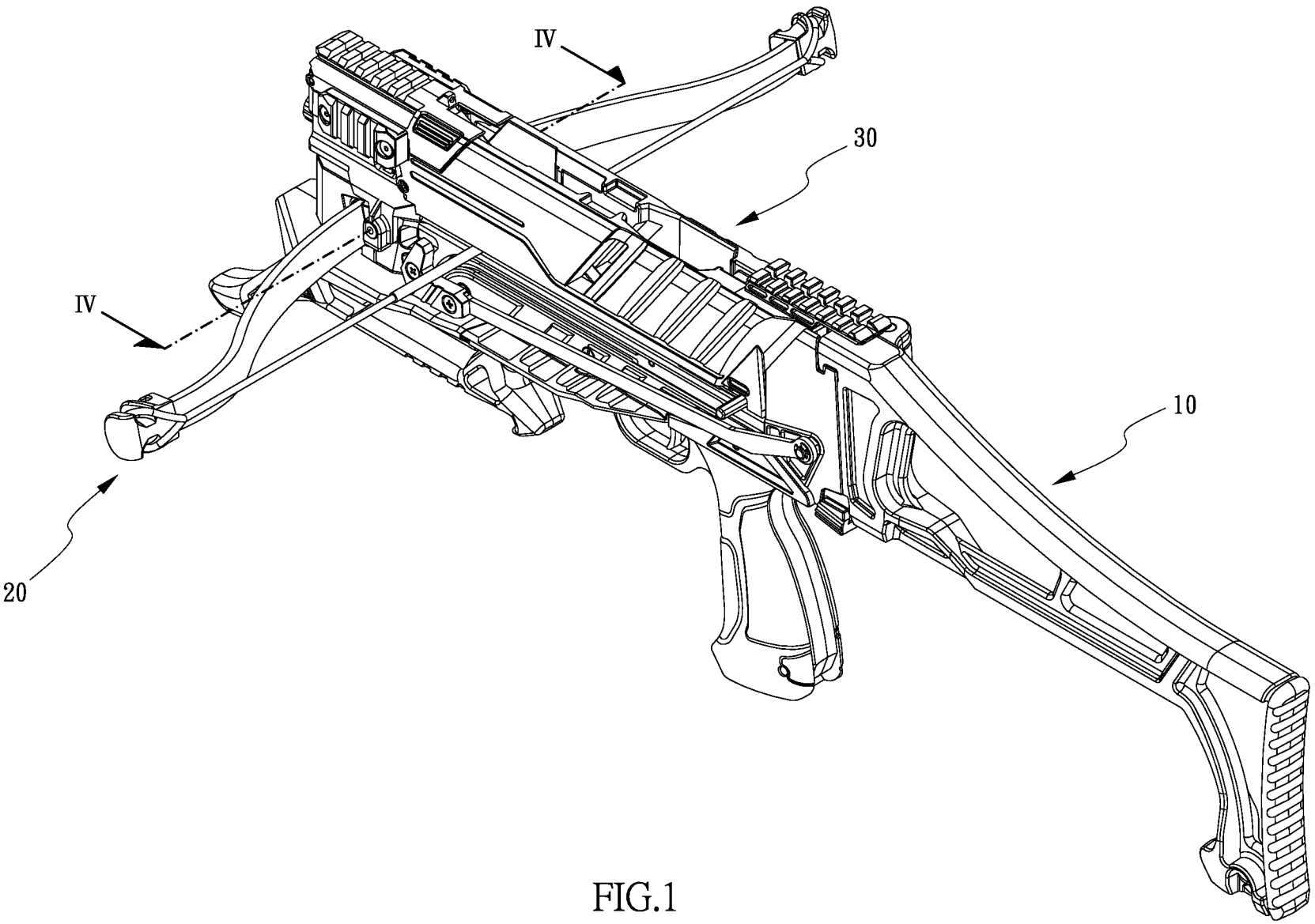
FIG. 1 is a perspective view to show the crossbow of the present invention.
Figure 2:
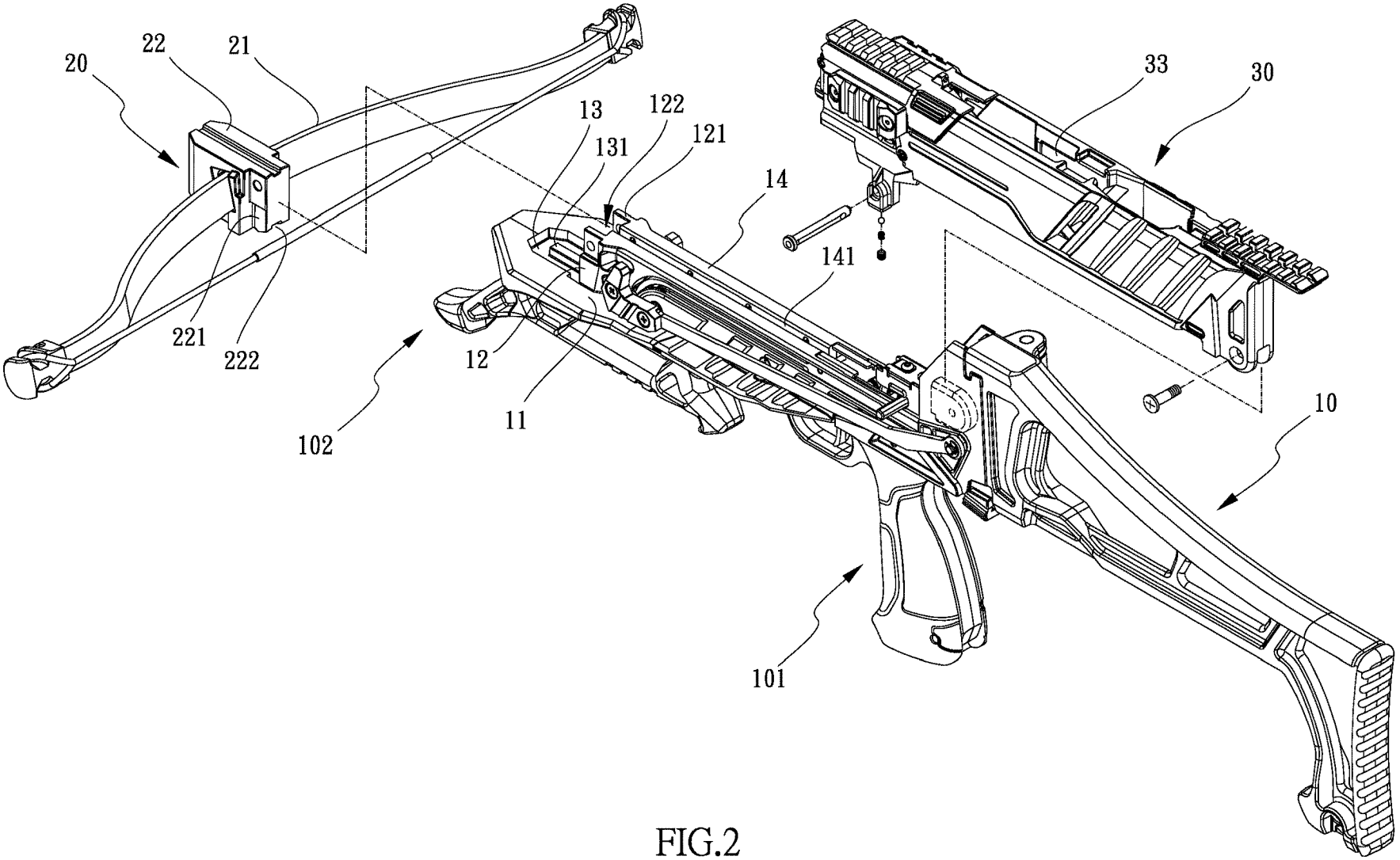
FIG. 2 is an exploded view of the crossbow of the present invention.
Figure 3:
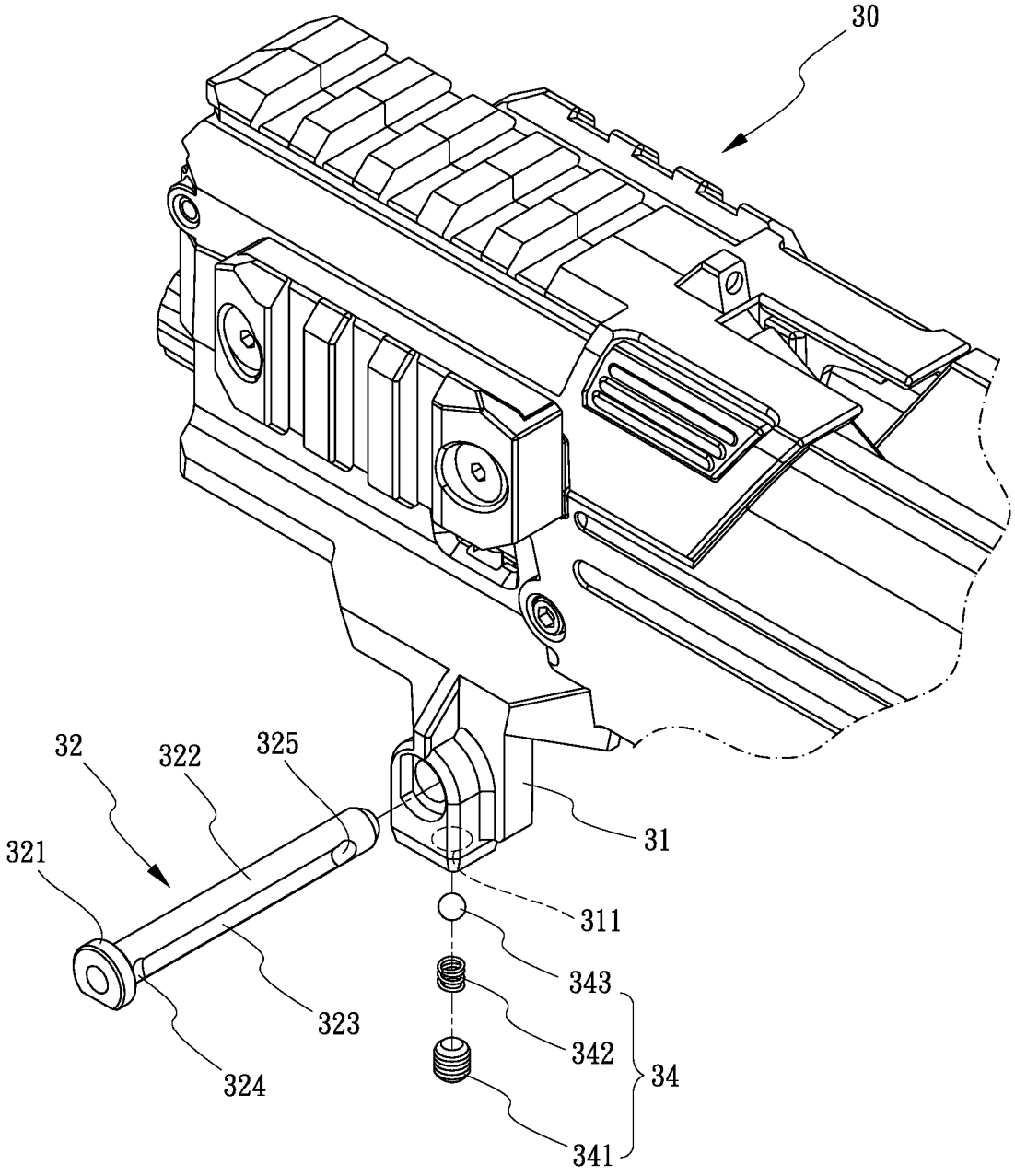
FIG. 3 shows the pin, one of the two lugs of the magazine and the positioning unit of the crossbow of the present invention.

Referring to FIGS. 1 to 9, the crossbow of the present invention comprises a body 10 having a stock 101 and a connection end 102 respectively formed to two ends of the body 10. A connection part 11 is formed to the connection end 102 and includes a clamping portion 12. The clamping portion 12 includes two side plates 121 extending upward, and a space 122 is formed between the two side plates 121.

A bow unit 20 includes a bow 21 and a block 22 which is formed to the middle portion of the bow 21. The block 22 includes a protrusion 221 which protrudes toward the space 122 and is accommodated in the space 122, so that the protrusion 221 is clamped between the two side plates 121 to connect the bow unit 20 to the connection part 11.

A magazine 30 has the first end thereof pivotably connected to a position that is located close to the stock 101 of the body 10. The second end of the magazine 30 is removably connected to the clamping portion 12. The magazine 30 includes two lugs 31 extending from the underside thereof. The clamping portion 12 is located between the two lugs 31, and a pin 32 extends through the two lugs 31, the two side plates 121 of the clamping portion 12 and the block 221 to secure the second end of the magazine 30 to the clamping portion 12.

The magazine 30 includes a path 33 defined therethrough, and the body 10 of the crossbow includes a top portion 14 protruding from the top thereof. The top portion 14 is formed with the clamping portion 12 and includes a flight groove 141. The flight groove 141 of the top portion 14 communicates with the path 33 of the magazine 30 when the magazine 30 is connected to the top of the body 10.

Figure 7:
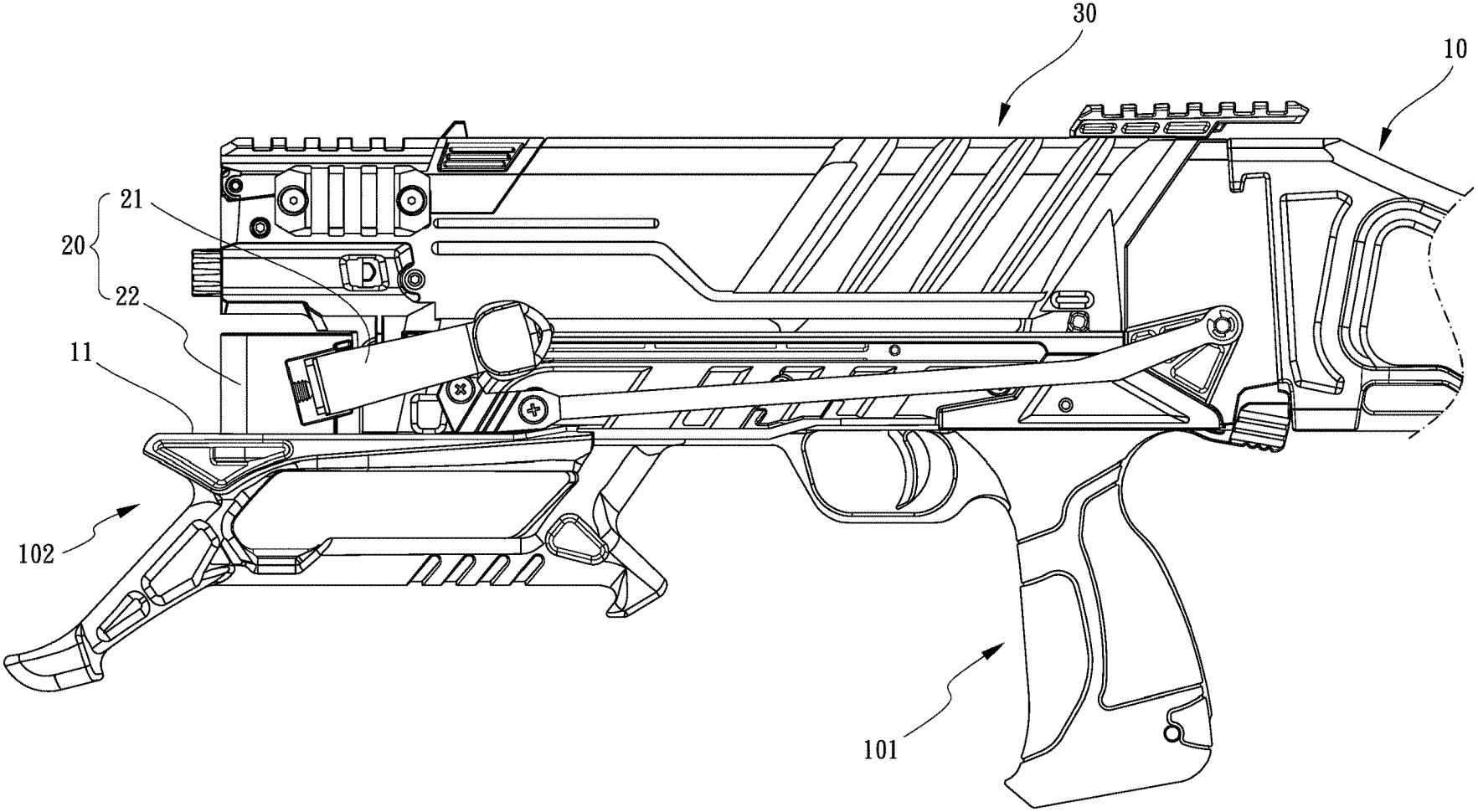
FIG. 7 is an enlarged view of the disclosure in FIG. 5.
Figure 8:
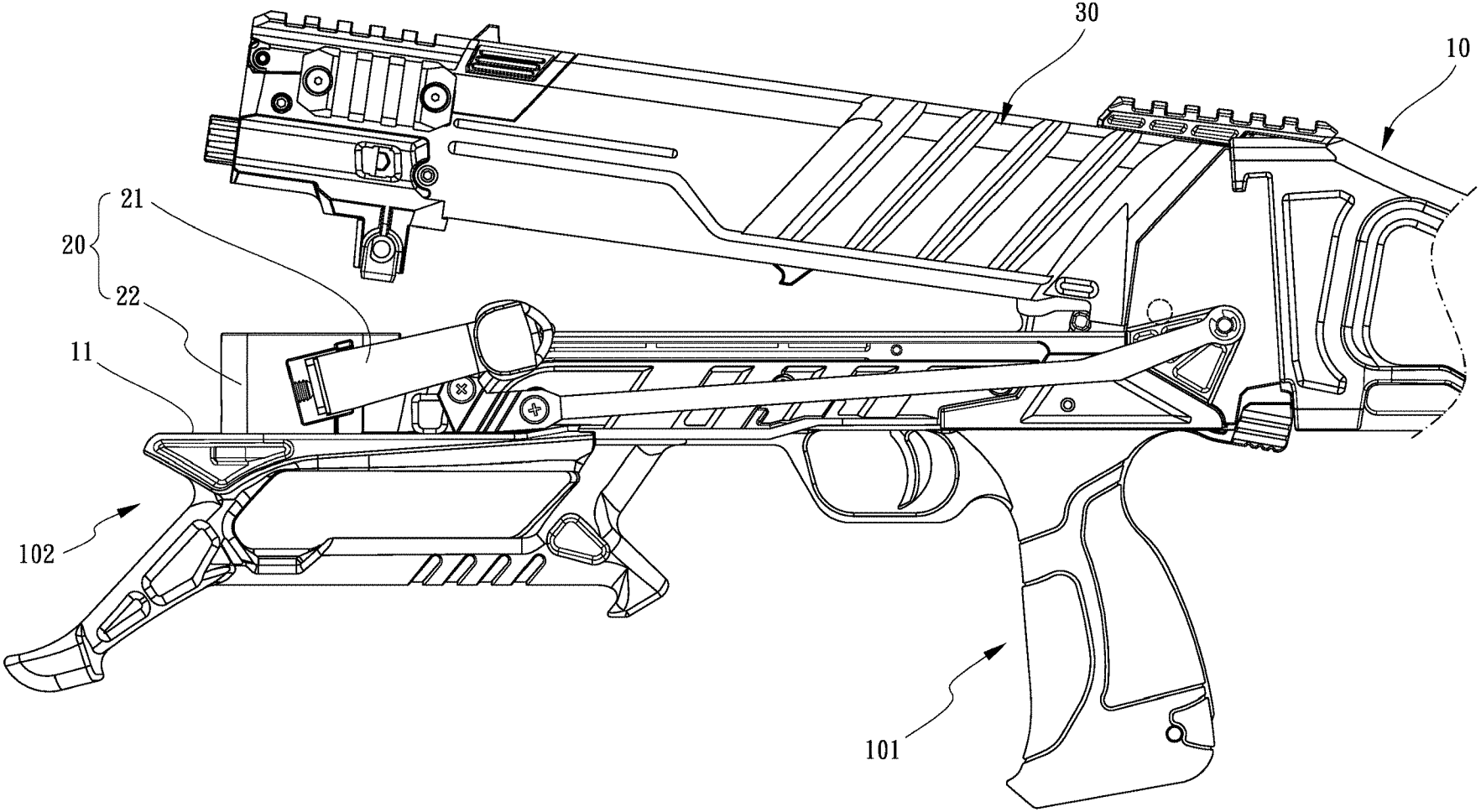
FIG. 8 shows that the second end of the magazine is pivoted away the body.
Figure 9:
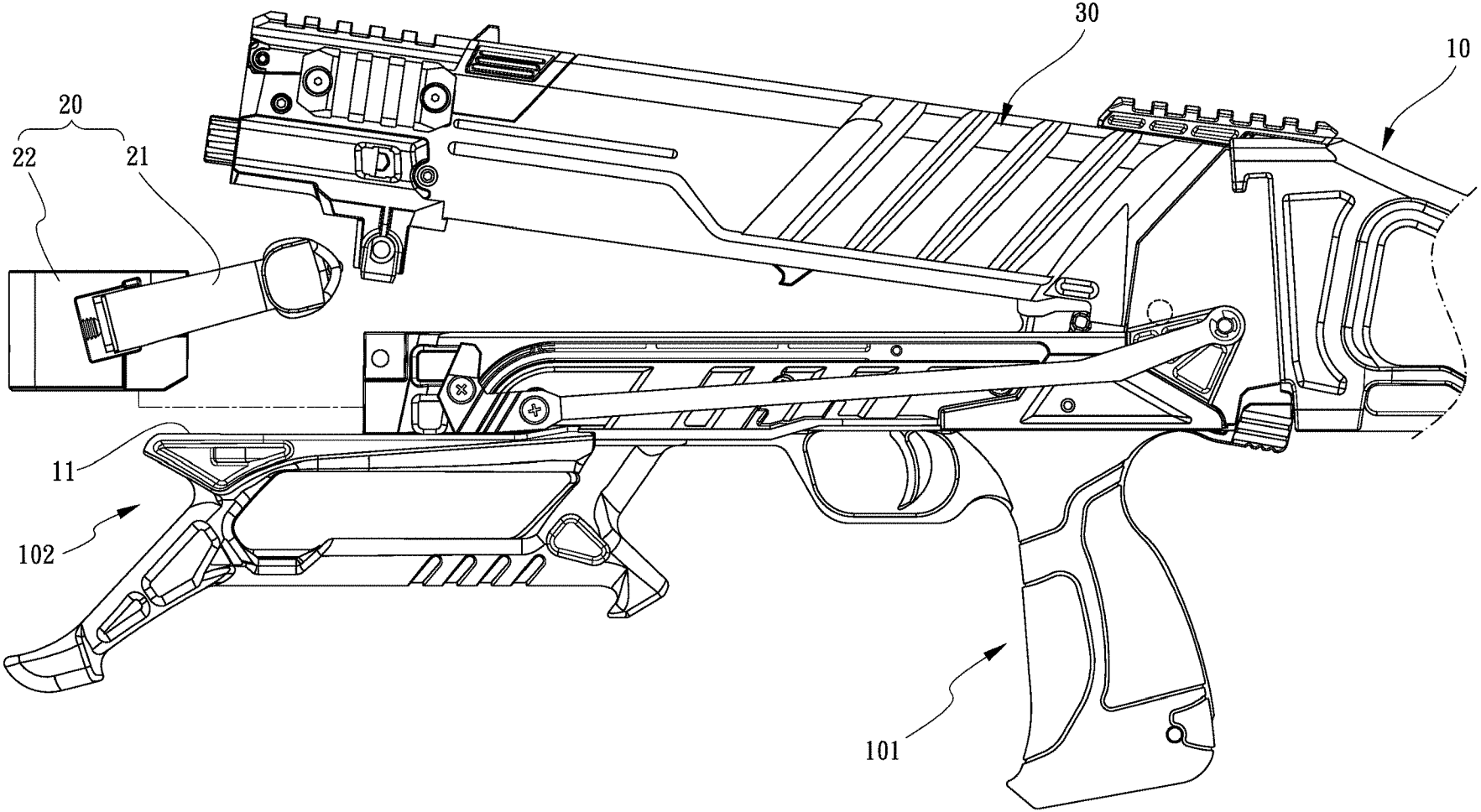
FIG. 9 shows that the bow unit is separated from the body of the crossbow of the present invention.

When installing the magazine 30, the first end of the magazine 30 is pivotably connected to the body 10, and the second end of the magazine 30 is pivoted toward the clamping portion 12 to locate the clamping portion 12 between the two lugs 31. The pin 32 extends through the two lugs 31, the two side plates 121 of the clamping portion 12 and the block 221 to secure the second end of the magazine 30 to the clamping portion 12 as shown in FIGS. 4, 5 and 7.

The magazine 30 is secured to the body 10 of the crossbow at the first end and the second end of the magazine 30. Multiple arrows (not shown) are loaded in the magazine 30 via the path 33, so that the arrows can be fed into the flight groove 141 one by one. The replacement of the bow unit 20 is convenient by simply pulling the pin 32 out from the protrusion 221 of the bow unit 20 to allow the second end of the magazine 30 to be pivoted away from the clamping portion 12. Then the new bow unit 20 can be installed to the crossbow, and the pin 32 extends through the two lugs 31, the two side plates 121 of the clamping portion 12 and the block 221 again to secure the second end of the magazine 30 to the clamping portion 12. During the replacement processes, the first end of the magazine 30 is connected to the body 10 of the crossbow.

Specifically, as shown in FIGS. 2, 3, 4 and 6, the connection part 11 includes a slot 13 defied therethrough, and a tongue 131 protrudes from the inner end of the slot 13. The block 22 is partially located in the slot 13 and includes a recess 222 defined in the underside thereof. The tongue 131 is engaged with the recess 222 when the block 221 is located in the slot 13 to reinforce the connection between the bow unit 20 and the body 10. The pin 32 includes a head 321 and a shank 322 which is formed with the head 321. The shank 322 includes a positioning groove 323 formed axially therein. A first dent 324, and a second dent 325 are respectively formed to the shank 322 and communicate with two ends of the positioning groove 323.

Figure 4:
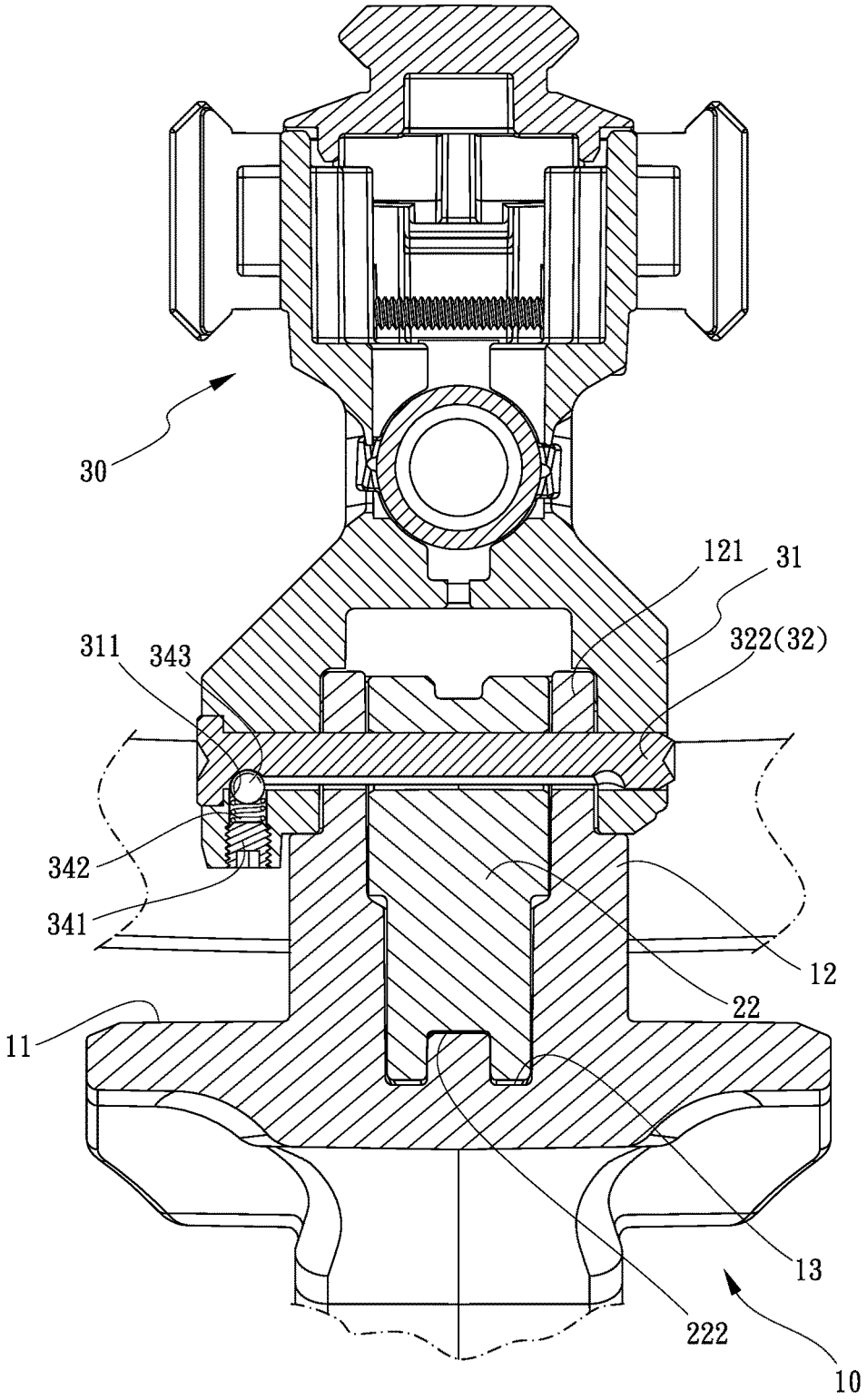
FIG. 4 is a cross sectional view, taken along line IV-IV in FIG. 1.
Figure 5:
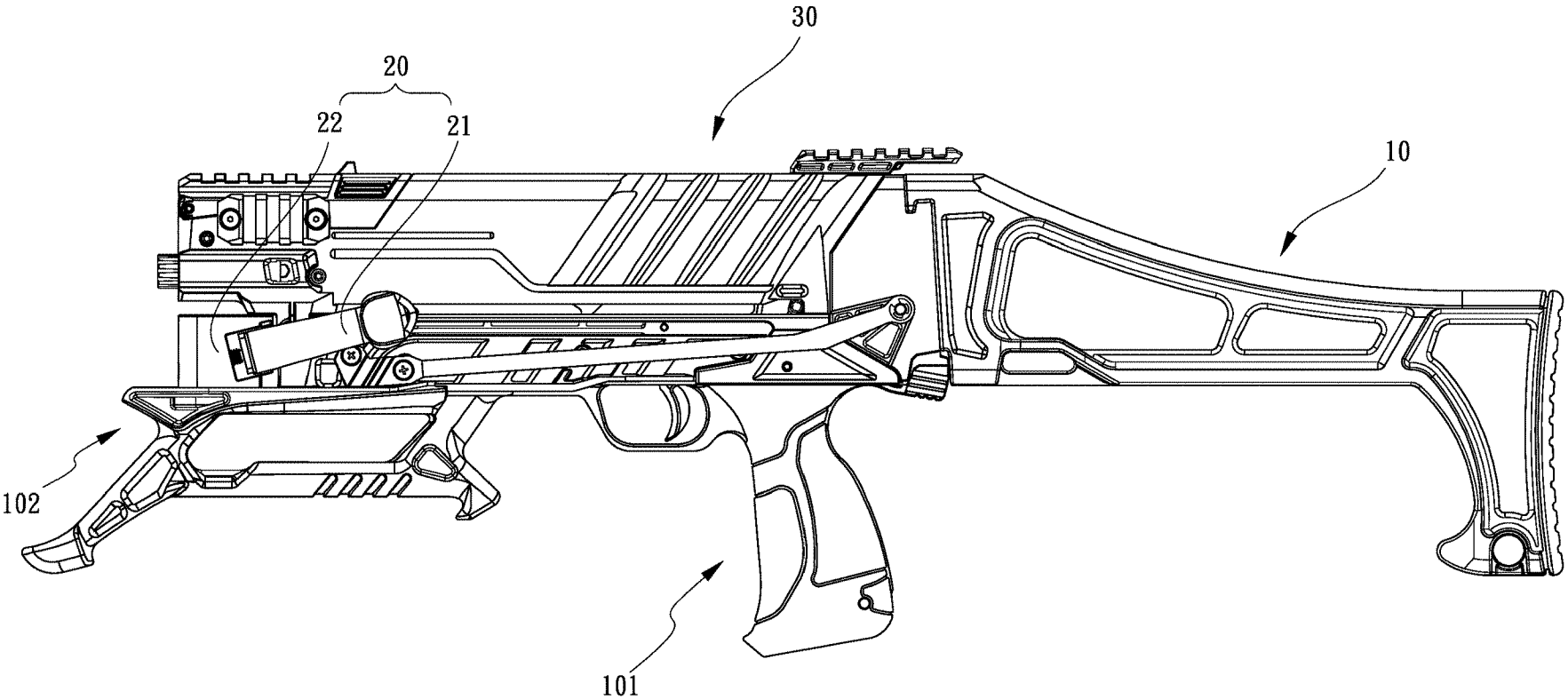
FIG. 5 is a side view of the crossbow of the present invention.
Figure 6:
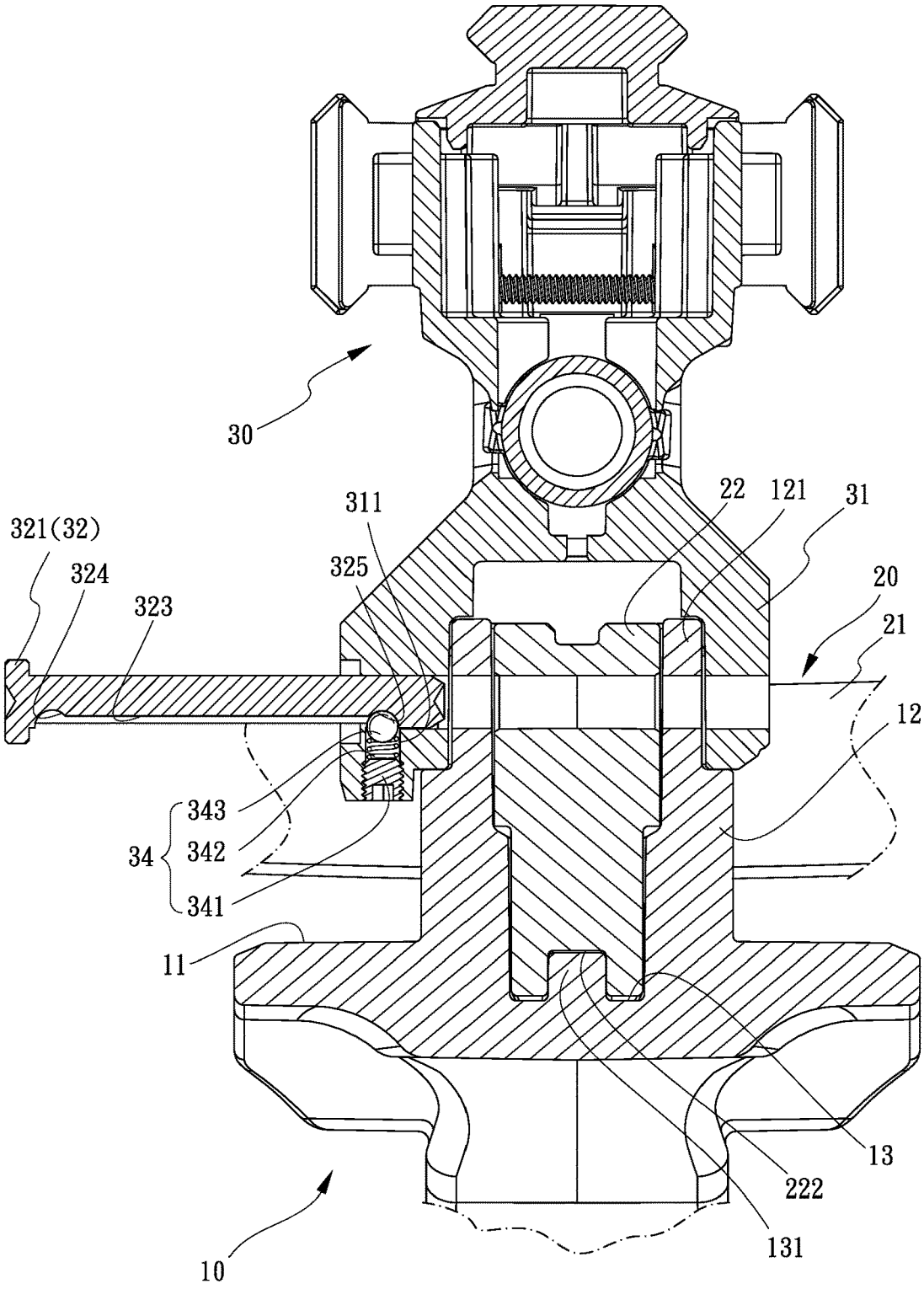
FIG. 6 shows that the pin is pulled from the clamping portion and the protrusion of the bow unit.

As shown in FIGS. 4 and 6, one of the two lugs 31 includes a hole 311 which is located corresponding to the positioning groove 323 of the pin 32. A positioning unit 34 is located in the hole 311 and includes a screw 341, a spring 342 and a ball 343. The screw 341 is threadedly connected to the hole 311 to prevent the spring 342 and the ball 343 from dropping from the hole 311. The spring 342 is biased between the screw 341 and the ball 343, and the ball 343 is engaged with the positioning groove 323 of the pin 32 so restrict the pin 32 from dropping from the lugs 31. When the pin 32 extends through the two lugs 31, the two side plates 121 of the clamping portion 12 and the block 221 to connect the bow unit 20 and the magazine 30 to the body 10 as shown in FIG. 4, the ball 343 is engaged with the first dent 324 of the pin 32. As shown in FIG. 6, when the pin 32 is pulled out from the protrusion 221 and the two side plates 121, the ball 343 is engaged with the second dent 325 of the pin 32 to position the pin 32.

While we have shown and described the embodiment in accordance with the present invention, it should be clear to those skilled in the art that further embodiments may be made without departing from the scope of the present invention.

What is claimed is:

1. A crossbow comprising:

a body having a stock and a connection end respectively formed to two ends of the body, a connection part formed to the connection end and including a clamping portion, the clamping portion including two side plates, and a space formed between the two side plates;

a bow unit including a bow and a block which is formed to a middle portion of the bow, the block including a protrusion which is accommodated in the space and clamped between the two side plates so as to connect the bow unit to the connection part, and a magazine having a first end thereof pivotably connected to the body, a second end of the magazine removably connected to the clamping portion, the magazine including two lugs, the two side plates of the clamping portion being located between the two lugs, a pin extending through the two lugs, the two side plates of the clamping portion and the protrusion of the block.

2. The crossbow as claimed in claim 1, wherein the connection part includes a slot defined therethrough, a tongue extends from the connection part, the block is partially located in the slot and includes a recess defined in an underside thereof, the tongue is engaged with the recess.

3. The crossbow as claimed in claim 1, wherein the magazine includes a path defined therethrough, the body includes a top portion protruding from a top thereof, the top portion is formed with the clamping portion and includes a flight groove, the flight groove of the top portion communicates with the path of the magazine when the magazine is connected to the top of the body.

4. The crossbow as claimed in claim 1, wherein the pin includes a head and a shank which is formed with the head, the shank includes a positioning groove formed axially therein, a first dent, and a second dent are respectively formed to the shank and communicate with two ends of the positioning groove.

5. The crossbow as claimed in claim 4, wherein one of the two lugs includes a hole which is located corresponding to the positioning groove of the pin, a positioning unit is located in the hole and includes a screw, a spring and a ball, the screw is threadedly connected to the hole, the spring is biased between the screw and the ball, the ball is engaged with the positioning groove of the pin so restrict the pin from dropping from the lugs.

* * * * *